US008109256B2

(12) United States Patent
Xiao et al.

(10) Patent No.: US 8,109,256 B2
(45) Date of Patent: Feb. 7, 2012

(54) SOLENOID CURRENT CONTROL WITH DIRECT FORWARD PREDICTION AND ITERATIVE BACKWARD STATE ESTIMATION

(75) Inventors: Yun Xiao, Ann Arbor, MI (US); Steven Douglas Stiles, Clarkston, MI (US); Carnell E. Williams, Pontiac, MI (US); Ping Ge, Northville Township, MI (US)

(73) Assignee: GM Global Technology Operations LLC

( * ) Notice: Subject to any disclaimer, the term of this patent is extended or adjusted under 35 U.S.C. 154(b) by 477 days.

(21) Appl. No.: 12/272,126

(22) Filed: Nov. 17, 2008

(65) Prior Publication Data

US 2010/0122691 A1 May 20, 2010

(51) Int. Cl.
*F02M 51/00* (2006.01)

(52) U.S. Cl. ..... 123/490; 123/491

(58) Field of Classification Search ..... 123/490, 123/491, 564, 559, 559.2, 561, 562; 60/600, 60/602, 605.1, 612

See application file for complete search history.

(56) References Cited

U.S. PATENT DOCUMENTS

| | | | | |
|---|---|---|---|---|
| 5,442,515 | A * | 8/1995 | Wallaert | 361/187 |
| 5,790,364 | A * | 8/1998 | Mikami et al. | 361/154 |
| 5,968,102 | A * | 10/1999 | Ichimaru et al. | 701/37 |
| 6,722,347 | B2 * | 4/2004 | Sanchez et al. | 123/520 |
| 7,054,772 | B2 * | 5/2006 | Iannone et al. | 702/65 |
| 7,377,480 | B2 * | 5/2008 | Tabor et al. | 251/129.04 |

FOREIGN PATENT DOCUMENTS

| | | | |
|---|---|---|---|
| DE | 4140586 | A1 | 1/1994 |
| DE | 10235432 | A1 | 11/2003 |
| JP | 63175905 | A * | 7/1988 |
| JP | 09079096 | A * | 3/1997 |

* cited by examiner

*Primary Examiner* — Stephen K Cronin
*Assistant Examiner* — Raza Najmuddin

(57) ABSTRACT

An engine control system comprises a current control module and a solenoid actuator module. The current control module determines a duty cycle based on a desired current through a solenoid of an engine system and a resistance of the solenoid and corrects the resistance based on an actual current through the solenoid. The solenoid actuator module actuates the solenoid based on the duty cycle.

20 Claims, 4 Drawing Sheets

SOLENOID CURRENT CONTROL WITH DIRECT FORWARD PREDICTION AND ITERATIVE BACKWARD STATE ESTIMATION

FIELD

The present disclosure relates to solenoid current control and more particularly to solenoid current control in an engine system.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A diesel engine combusts an air/fuel mixture to produce drive torque for a vehicle. Air is drawn into cylinders through an intake manifold. A fuel system injects fuel directly into the cylinders. The byproducts of combustion are exhausted from the vehicle via an exhaust manifold.

A high-pressure (HP) turbocharger and a low-pressure (LP) turbocharger are powered by exhaust gases flowing through the exhaust manifold and provide an HP compressed air charge and an LP compressed air charge, respectively, to the intake manifold. A bypass valve assembly may allow exhaust gas to bypass the HP turbocharger, thereby reducing the HP compressed air charge and an expansion ratio across the HP turbocharger. The bypass valve assembly typically includes a butterfly valve and a magnetic solenoid actuator. The magnetic solenoid actuator typically includes a solenoid coil and a magnetic core. The bypass valve is opened and closed by selectively supplying current through the solenoid coil. Control systems such as an engine control system may control the solenoid current to regulate opening of the bypass valve.

Traditional engine control systems, however, do not control the solenoid current as accurately or quickly as desired. For example, an engine control system may determine the solenoid current based on a solenoid temperature. However, solenoid variations and/or system aging may affect accuracy of the system. An engine control system may include a fast-response proportional-integral-derivative (PID) control scheme (e.g., 5 milliseconds) to control the solenoid current. However, a slow-response filter (e.g., 100 milliseconds) may be required to smooth the signal of feedback to remove short-term oscillations due to aliasing.

SUMMARY

An engine control system comprises a current control module and a solenoid actuator module. The current control module determines a duty cycle based on a desired current through a solenoid of an engine system and a resistance of the solenoid and corrects the resistance based on an actual current through the solenoid. The solenoid actuator module actuates the solenoid based on the duty cycle.

A method of operating an engine control system comprises determining a duty cycle based on a desired current through a solenoid of an engine system and a resistance of the solenoid; correcting the resistance based on an actual current through the solenoid; and actuating the solenoid based on the duty cycle.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
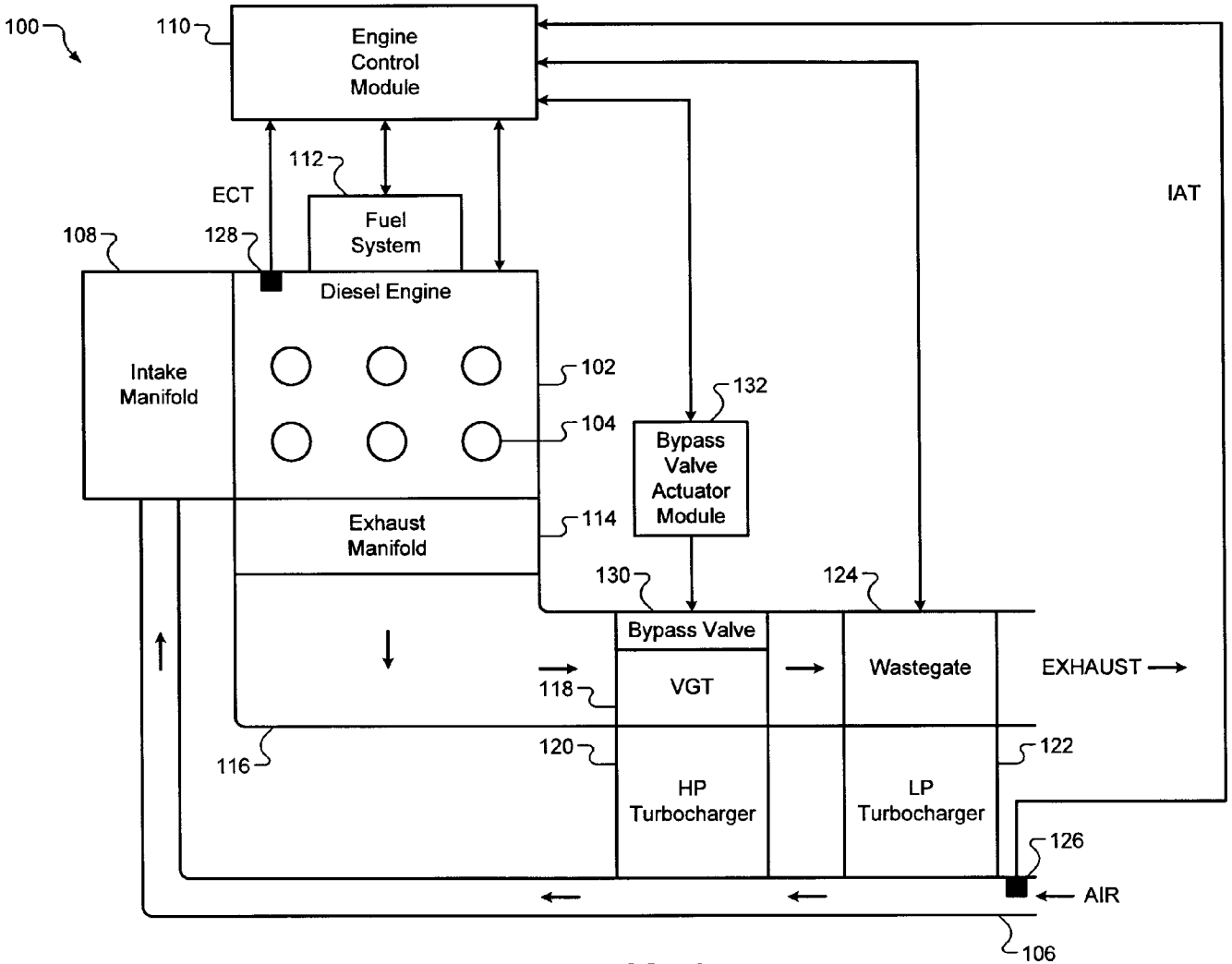
FIG. 1 is a functional block diagram of an exemplary diesel engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

To accurately and rapidly control a solenoid current in a diesel engine system, the engine control system of the present disclosure predicts a duty cycle of a desired current through a solenoid. The duty cycle is predicted based on a slow-varying system parameter that defines a linear relationship between the duty cycle and an actual current through the solenoid. The engine control system corrects the slow-varying system parameter based on the predicted duty cycle, the desired current, and/or the resulting actual current. While the operation of the engine control system will be discussed as it relates to the bypass valve, the principles of the present disclosure are also applicable to any device that includes at least one solenoid. For example, devices may include, but are not limited to, a Variable Nozzle Turbine (VNT) of a turbocharger and/or metering valves of a common-rail direct fuel injection system.

Referring now to FIG. 1, a functional block diagram of an exemplary diesel engine system 100 is shown. The diesel engine system 100 includes a diesel engine 102 that combusts an air/fuel mixture to produce drive torque for a vehicle. The diesel engine 102 includes cylinders 104. For illustration purposes, six cylinders are shown. For example only, the diesel engine 102 may include, but is not limited to, 2, 3, 4, 5, 6, 8, 10, and/or 12 cylinders.

The diesel engine system 100 further includes an air line 106, an intake manifold 108, an engine control module 110, a fuel system 112, an exhaust manifold 114, and an exhaust line 116. The diesel engine system 100 further includes a variable geometry turbocharger (VGT) 118, a high-pressure (HP) turbocharger 120, a low-pressure (LP) turbocharger 122, a wastegate 124, an intake air temperature (IAT) sensor 126, and an engine coolant temperature (ECT) sensor 128. The diesel engine system 100 further includes a bypass valve 130 and a bypass valve actuator module 132.

Air is drawn into the intake manifold 108 through the air line 106. Air from the intake manifold 108 is drawn into the cylinders 104. The engine control module 110 controls the amount of fuel injected by the fuel system 112. The fuel system 112 injects fuel directly into the cylinders 104.

The injected fuel mixes with the air and creates the air/fuel mixture in the cylinders 104. Pistons (not shown) within the cylinders 104 compress the air/fuel mixture. The compressed air/fuel mixture is auto-ignited near the top dead centre of the cylinders 104.

The combustion of the air/fuel mixture drives the pistons down, thereby driving a crankshaft (not shown). The pistons then begin moving up again and expel the byproducts of combustion through the exhaust manifold 114. The byproducts of combustion are exhausted from the vehicle via the exhaust line 116.

The HP turbocharger 120 and the LP turbocharger 122 are powered by exhaust gas flowing through the exhaust line 116 and provide an HP compressed air charge and an LP compressed air charge, respectively, to the intake manifold 108. The HP compressed air charge and the LP compressed air charge are provided to the intake manifold 108 through the air line 106. The air used to produce the compressed air charges is taken from the air line 106. The VGT 118 receives exhaust gas and alters the output (i.e., the boost) of the HP turbocharger 120 based on the position (i.e., the aspect ratio) of the VGT 118. The wastegate 124 may allow exhaust gas to bypass the LP turbocharger 122 to avoid placing too high of an exhaust pressure on the turbine of the LP turbocharger 122.

An ambient temperature of air being drawn into the diesel engine system 100 (i.e., an IAT) may be measured using the IAT sensor 126. A temperature of the engine coolant (i.e., an ECT) may be measured using the ECT sensor 128. The ECT sensor 128 may be located within the diesel engine 102 or at other locations where the coolant is circulated, such as in a radiator (not shown). The engine control module 110 uses signals from the sensors 126 and 128 to make control decisions for the diesel engine system 100. The engine control module 110 controls and communicates with the diesel engine 102, the fuel system 112, the VGT 118 (not shown), the turbochargers 120 and 122 (not shown), the wastegate 124, and the bypass valve 130 as described herein.

The bypass valve 130 may allow exhaust gas to bypass the HP turbocharger 120, thereby reducing the boost of the HP turbocharger 120 and an expansion ratio across the HP turbocharger 120. The bypass valve 130 includes a solenoid valve that is controlled by running or stopping an electrical current through a solenoid, thus opening or closing the solenoid valve. The engine control module 110 commands the bypass valve actuator module 132 to regulate opening of the bypass valve 130 to control the amount of exhaust gas released to the HP turbocharger 120. In addition, the bypass valve actuator module 132 may measure the position of the bypass valve 130 and output a signal based on the position to the engine control module 110. The engine control module 110 determines the commands to the bypass valve actuator module 132 as described herein.

Figure 2:
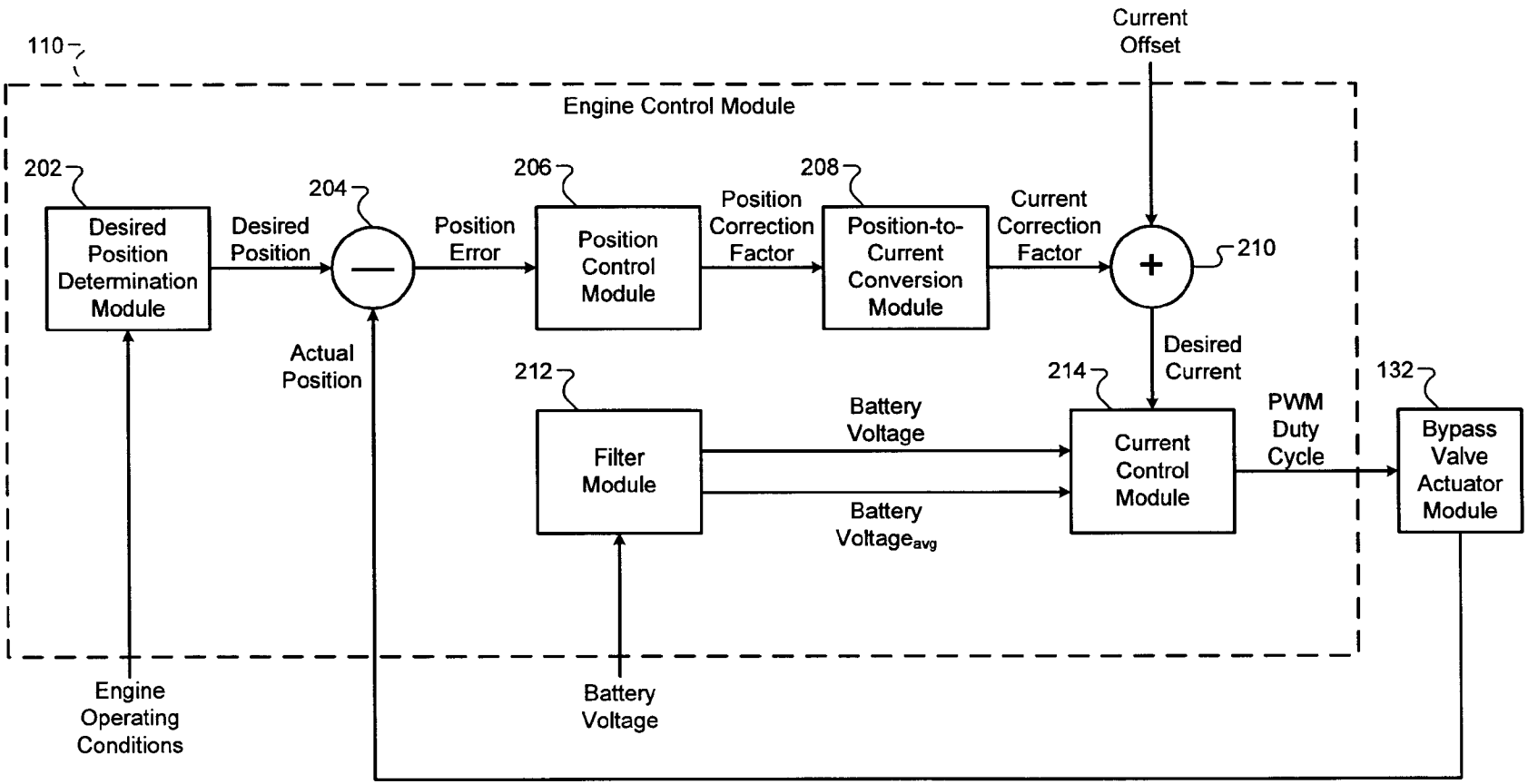
FIG. 2 is a functional block diagram of an exemplary engine control module according to the principles of the present disclosure.

Referring now to FIG. 2, a functional block diagram of the engine control module 110 is shown. The engine control module 110 includes a desired position determination module 202, a subtraction module 204, and a position control module 206. The engine control module 110 further includes a position-to-current conversion module 208, a summation module 210, a filter module 212, and a current control module 214.

The desired position determination module 202 receives data on engine operating conditions from sensors of the diesel engine system 100. For example only, the engine operating conditions may include, but are not limited, to an engine speed, an actual pressure within the intake manifold 108, and/or a desired pressure within the intake manifold 108 to be reached by the turbochargers 120 and 122. The desired position determination module 202 determines a desired position of the bypass valve 130 based on models that relate the desired position to the engine operating conditions. The subtraction module 204 receives the desired position and an actual position of the bypass valve 130 from the bypass valve actuator module 132. The subtraction module 204 subtracts the actual position from the desired position to determine a position error.

The position control module 206 receives the position error and determines a position correction factor based on the position error. The position control module 206 uses a proportional-integral-derivative (PID) control scheme to determine the position correction factor. For example only, the position correction factor may be in units of percentage and may include a predetermined range of values from −100% to 100%.

The position-to-current conversion module 208 receives the position correction factor. The position-to-current conversion module 208 converts the position correction factor to a current correction factor based on a model that relates the position correction factor to the current correction factor. For example only, the current correction factor may be in units of amperes (A) and may include a predetermined range of values from 0 A to 1 A. For example only, when the position correction factor is equal to zero, the current correction factor may be equal to 0.5 A.

The summation module 210 receives the current correction factor and a current offset from data memory (not shown). The current offset is the amount of current when the bypass valve 130 is at a null position (i.e., an initial position) and is determined based on the type of the solenoid at engine startup. The summation module 210 sums the current correction factor and the current offset to determine a desired current for the solenoid of the bypass valve 130.

The filter module 212 receives a battery voltage from a battery (not shown) that creates the electrical current for the solenoid. The filter module 212 filters the battery voltage for use by the current control module 214. For example only, the filter module 212 may include a low-pass filter that smoothes the signal of the battery voltage to remove short-term oscillations. In addition, the filter module 212 determines an average of the battery voltage and filters the average to determine an average battery voltage (i.e., a battery voltage$_{avg}$).

The current control module 214 receives the battery voltage, the average battery voltage, and the desired current. The current control module 214 determines (i.e., predicts) a pulse-width modulation of a duty cycle of the desired current (i.e., a PWM duty cycle). The current control module 214 determines the PWM duty cycle further based on at least one the battery voltage and the average battery voltage. The bypass valve actuator module 132 receives the PWM duty cycle and regulates opening of the bypass valve 130 based on the PWM duty cycle.

Figure 3:
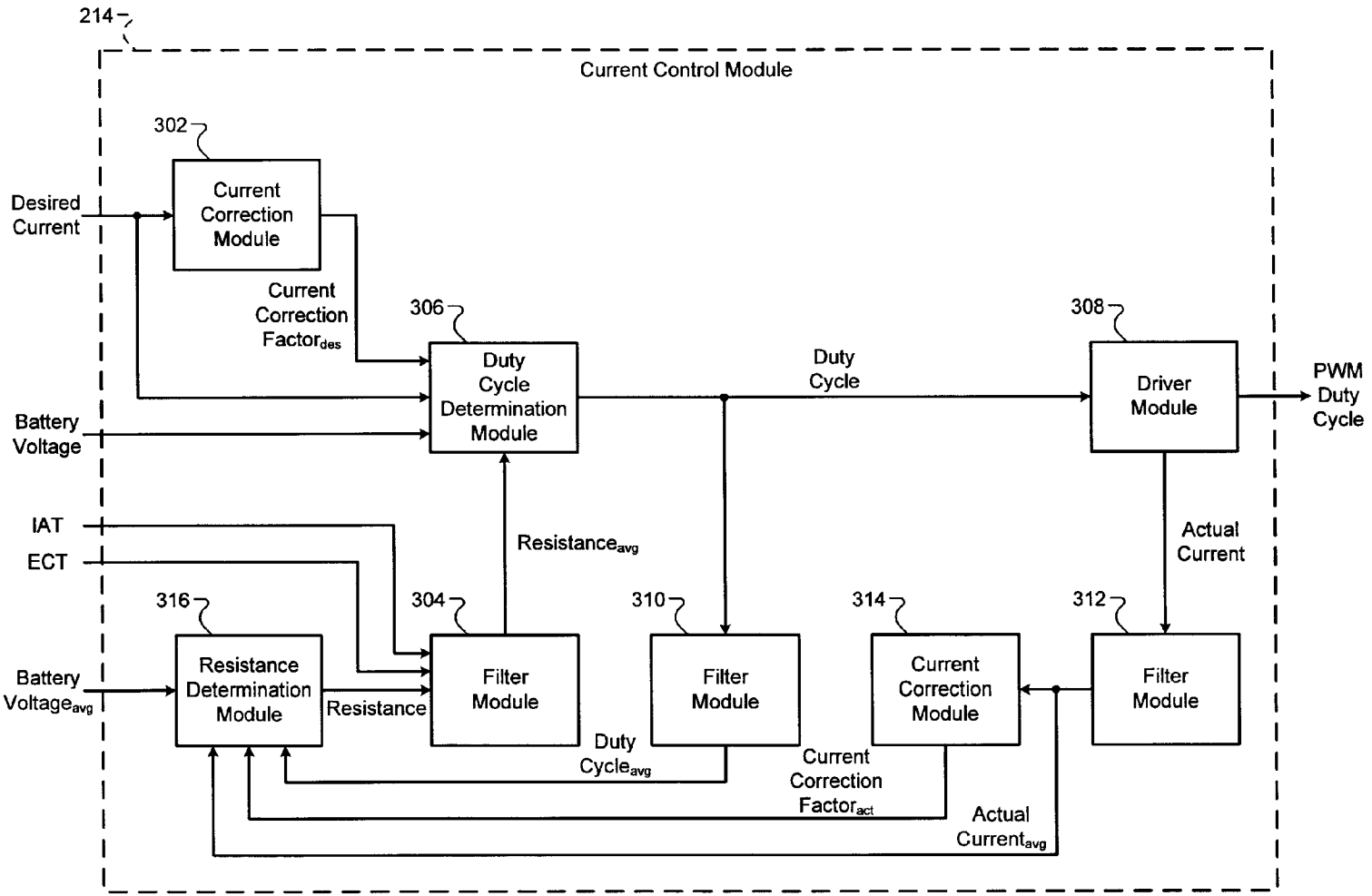
FIG. 3 is a functional block diagram of an exemplary current control module according to the principles of the present disclosure.

Referring now to FIG. 3, a functional block diagram of the current control module 214 is shown. The current control module 214 includes a current correction module 302, a filter module 304, a duty cycle determination module 306, and a driver module 308. The current control module 214 further includes a filter module 310, a filter module 312, a current correction module 314, and a resistance determination module 316.

The current correction module 302 receives the desired current. The current correction module 302 determines a desired current correction factor (i.e., a current correction factor$_{des}$) based on a model that relates the desired current correction factor to the desired current. The desired current correction factor accounts for non-linearity in the relationship between the desired current and the duty cycle of the desired current.

At engine startup, the filter module 304 receives the IAT and the ECT and determines a resistance based on a model that relates the initial resistance to the IAT and the ECT. The resistance is a slow-varying system parameter that defines a linear relationship between the duty cycle of the desired current and an actual current through the solenoid of the bypass valve 130. While the operation of the current control module 214 will be discussed as it relates to the resistance, the principles of the present disclosure are also applicable to any slow-varying system parameter that defines the linear relationship between the duty cycle and the actual current. For example, the slow-varying system parameter may include, but is not limited to, an impedance that is determined based on a temperature in the solenoid.

In addition, the filter module 304 determines an average of the resistance and filters the average to determine an average resistance (i.e., a resistance$_{avg}$). The resistance is averaged because it is a slow-varying system parameter, not an instantaneous one. For example only, the filter module 304 may include a low-pass filter that smoothes the signal of the average resistance to remove short-term oscillations. For example only, the filter module 304 may include a variable filter time constant that ramps from a smaller value to a predetermined value during a time period after engine start up.

The duty cycle determination module 306 receives the average resistance, the desired current correction factor, the desired current, and the battery voltage. The duty cycle determination module 306 determines (i.e., predicts) the duty cycle of the desired current based on the average resistance, the desired current correction factor, the desired current, and the battery voltage. The duty cycle DC is determined according to the following equation:

$$DC = K(I_{des})\frac{I_{des} \times R_{avg}}{V}, \tag{1}$$

where $K(I_{des})$ is the desired current correction factor, $I_{des}$ is the desired current, $R_{avg}$ is the average resistance, and V is the battery voltage. The duty cycle is determined instantly (e.g., in 5 milliseconds). This is because the duty cycle determination module 306 does not wait (e.g., 100 milliseconds) to receive feedback (e.g., the actual current that is changed due to the previous duty cycle) to determine the new duty cycle.

The driver module 308 receives the duty cycle and modulates the duty cycle to determine the PWM duty cycle. The filter module 310 receives the duty cycle, determines an average of the duty cycle, and filters the average to determine an average duty cycle (i.e., a duty cycle$_{avg}$). The duty cycle is averaged because the resistance is a slow-varying system parameter, not an instantaneous one. For example only, the filter module 310 may include a low-pass filter that smoothes the signal of the average duty cycle to remove short-term oscillations. As can be appreciated, other signal conditioning such as reforming, filtering, amplification or other signal processing may be performed on any of the signals disclosed herein.

The driver module 308 includes a shunt (not shown) that is used to determine the actual current through the solenoid of the bypass valve 130. The filter module 312 receives the actual current, determines an average of the actual current, and filters the average to determine an average actual current (i.e., an actual current$_{avg}$). The actual current is averaged because the resistance is a slow-varying system parameter, not an instantaneous one. For example only, the filter module 312 may include a low-pass filter that smoothes the signal of the average actual current to remove short-term oscillations.

The current correction module 314 receives the average actual current. The current correction module 314 determines an actual current correction factor (i.e., a current correction factor$_{avg}$) based on a model that relates the actual current correction factor to the actual current. The actual current correction factor accounts for non-linearity in the relationship between the actual current and the duty cycle of the desired current.

The resistance determination module 316 receives the actual current correction factor, the average battery voltage, the average actual current, and the average duty cycle. The resistance determination module 316 determines (i.e., corrects) the resistance based on the actual current correction factor, the average battery voltage, the average actual current, and the average duty cycle. The resistance R is determined according to the following equation:

$$R = \frac{V_{avg} \times DC_{avg}}{K(I_{act\text{-}avg}) \times I_{act\text{-}avg}}, \tag{2}$$

where $V_{avg}$ is the average battery voltage, $DC_{avg}$ is the average duty cycle, $K(I_{act\text{-}avg})$ is the actual current correction factor, and $I_{act\text{-}avg}$ is the average actual current.

When the average actual current is equal to zero, the resistance determination module 316 may determine the resistance based on a small predetermined current instead of the average actual current. The small current does not affect the desired position. The corrected resistance is outputted to the filter module 304 where the corrected resistance is used to determine (i.e., correct) the average resistance for the duty cycle determination module 306. This correction allows the duty cycle to be determined accurately and instantly even though the resistance is being corrected more slowly (e.g., 100 milliseconds).

For example only, the resistance may be initially determined to be less than its actual value. As a result, the duty cycle may be determined to be less than its desired value, and the actual current may be determined to be less than the desired current. However, since the actual current is in the denominator of the equation to correct the resistance, the underdetermined actual current may raise the resistance iteratively until the actual current equals the desired current.

In another implementation, the resistance determination module 316 receives the average actual current, the desired current (not shown), and a filtered average of the desired current (not shown). The resistance determination module 316 determines (i.e., corrects) the resistance based on the average actual current, the desired current, and the average desired current. The fresistance $R_i$ is determined according to the following equation:

$$R_i = R_{i-1}\left[1 + \alpha\frac{I_{des\text{-}avg} - I_{act\text{-}avg}}{I_{des}}\right], \quad (3)$$

where $R_{i-1}$ is the resistance during the previous control loop, $\alpha$ is a predetermined smoothing factor, and $I_{des\text{-}avg}$ is the average desired current. The resistance is corrected iteratively until the actual current equals the desired current.

By determining the resistance, the engine control module 110 may determine a duty cycle offset (not shown) based on the resistance and the current offset. The duty cycle offset is the duty cycle of the actual current when the bypass valve 130 is at the null position. The duty cycle offset may be determined according to an equation similar to equation (1). Accordingly, determining the duty cycle offset based on the type of the solenoid at engine startup may be unnecessary.

Figure 4:
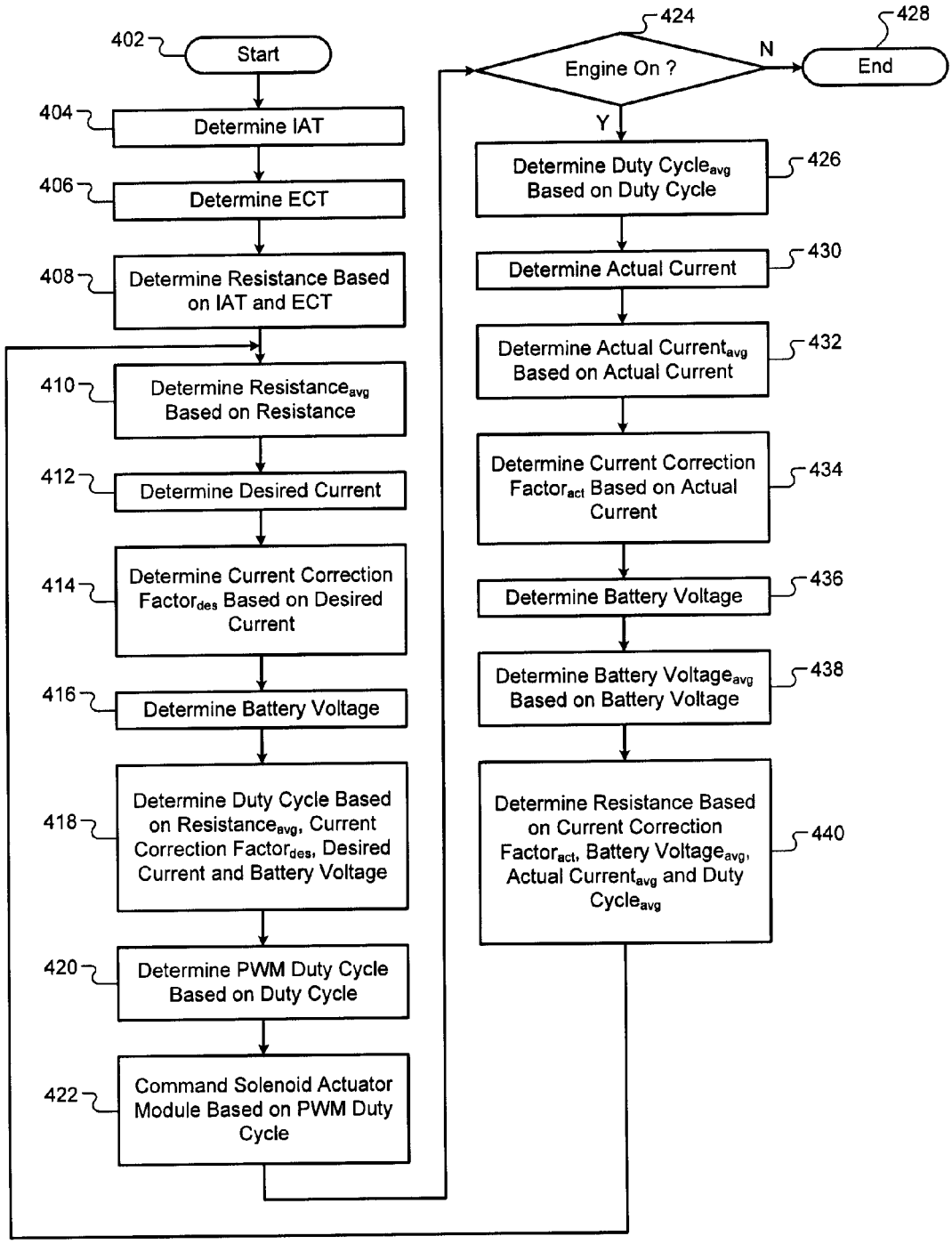
FIG. 4 is a flowchart depicting exemplary steps of an engine control method according to the principles of the present disclosure.

Referring now to FIG. 4, a flowchart depicting exemplary steps of an engine control method is shown. Control begins in step 402. In step 404, the IAT is determined. In step 406, the ECT is determined. In step 408, the resistance is determined based on the IAT and the ECT.

In step 410, the average resistance is determined based on the resistance. In step 412, the desired current is determined. In step 414, the desired current correction factor is determined based on the desired current. In step 416, the battery voltage is determined.

In step 418, the duty cycle is determined based on the average resistance, the desired current correction factor, the desired current, and the battery voltage. In step 420, the PWM duty cycle is determined based on the duty cycle. In step 422, the solenoid actuator module is commanded based on the PWM duty cycle.

In step 424, control determines whether the engine is still on. If true, control continues in step 426. If false, control continues in step 428. In step 426, the average duty cycle is determined based on the duty cycle. In step 430, the actual current is determined.

In step 432, the average actual current is determined based on the actual current. In step 434, the actual current correction factor is determined based on the average actual current. In step 436, the battery voltage is determined. In step 438, the average battery voltage is determined based on the battery voltage.

In step 440, the resistance is determined based on the actual current correction factor, the average battery voltage, the average actual current, and the average duty cycle. Control returns to step 410. Control ends in step 428.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system, comprising:

a resistance determination module that determines a resistance of a solenoid of an engine system, and that adjusts the determined resistance at a first rate based on a measured current through the solenoid;

a duty cycle determination module that determines a duty cycle for the solenoid at a second rate based on a desired current through the solenoid and the determined resistance of the solenoid, wherein the second rate is greater than the first rate; and a solenoid actuator module that actuates the solenoid based on the determined duty cycle.

2. The engine control system of claim 1 wherein the duty cycle determination module determines the duty cycle based on a filtered average of the determined resistance over a period after engine startup.

3. The engine control system of claim 1 wherein the resistance determination module determines the resistance based on an intake air temperature and an engine coolant temperature at engine startup.

4. The engine control system of claim 1 wherein the resistance determination module adjusts the determined resistance further based on a filtered average of a voltage of a battery for the solenoid over a period after engine startup.

5. The engine control system of claim 1 wherein the resistance determination module adjusts the determined resistance further based on a filtered average of the determined duty cycle over a period after engine startup.

6. The engine control system of claim 1 wherein the resistance determination module adjusts the determined resistance further based on a filtered average of the measured current over a period after engine startup.

7. A method of operating an engine control system, comprising:

determining a resistance of a solenoid of an engine system;

adjusting the determined resistance at a first rate based on a measured current through the solenoid;

determines a duty cycle for the solenoid at a second rate based on a desired current through the solenoid and the determined resistance of the solenoid, wherein the second rate is greater than the first rate; and actuating the solenoid based on the determined duty cycle.

8. The method of claim 7 further comprising determining the duty cycle further based on a filtered average of the determined resistance over a period after engine startup.

9. The method of claim 7 wherein the resistance of the solenoid is determined based on an intake air temperature and an engine coolant temperature at engine startup.

10. The method of claim 7 wherein the determined resistance is adjusted further based on a filtered average of a voltage of a battery for the solenoid over a period after engine startup.

11. The method of claim 7 wherein the determined resistance is adjusted further based on a filtered average of the determined duty cycle over a period after engine startup.

12. The method of claim 7 wherein the determined resistance is adjusted further based on a filtered average of the measured current over a period after engine startup.

13. The engine control system of claim 1, wherein the first rate is approximately every 100 milliseconds.

14. The engine control system of claim 1, wherein the second rate is approximately every 5 milliseconds.

15. The engine control system of claim 1, wherein the solenoid is implemented in one of a variable nozzle turbocharger (VNT), a metering valve, and a common-rail direct fuel injection system.

16. The method of claim 7, wherein the first rate is approximately every 100 milliseconds.

17. The method of claim 7, wherein the second rate is approximately every 5 milliseconds.

18. The method of claim 7, wherein the solenoid is implemented in one of a variable nozzle turbocharger (VNT), a metering valve, and a common-rail direct fuel injection system.

19. A system, comprising:

a first module that determines a resistance of a coil of an electromagnetic solenoid based on a temperature of an engine at engine startup;

a second module that generates adjusted resistances at a first rate, wherein each of the adjusted resistances is based on the determined resistance, a measured current flowing through the coil, a voltage supplied to the solenoid, and an average duty cycle for the solenoid;

a third module that generates an average resistance based on the determined resistance and the adjusted resistances;

a fourth module that determines a duty cycle for the solenoid based on the determined resistance, the voltage, and a desired current to flow through the coil;

a fifth module that generates adjusted duty cycles at a second rate, wherein the adjusted duty cycles are based on the determined duty cycle, the voltage, and the average resistance;

a sixth module that generates the average duty cycle based on the determined duty cycle and the adjusted duty cycles; and a seventh module that controls the solenoid based on a most recent one of the adjusted duty cycles.

20. The system of claim 19, wherein the first rate is approximately every 100 milliseconds, wherein the second rate is approximately every 5 milliseconds, and wherein each of the voltage, the measured current, the average resistance, and the average duty cycle are low-pass filtered.

* * * * *